US005501256A

United States Patent [19]

Dyer et al.

[11] Patent Number: 5,501,256

[45] Date of Patent: Mar. 26, 1996

[54] CHIPPER KNIFE

[75] Inventors: Daniel R. Dyer, Portland; James R. Sparks, Yamhill, both of Oreg.

[73] Assignee: U.S. Natural Resources, Inc., Vancouver, Wash.

[21] Appl. No.: 276,697

[22] Filed: Jul. 18, 1994

[51] Int. Cl.[6] ..... B27G 13/04

[52] U.S. Cl. ..... 144/241; 144/162 R; 144/218; 144/220; 241/92; 241/297; 407/41; 407/115

[58] Field of Search ..... 241/92, 297, 40, 241/87; 407/1, 2, 6, 41–46, 113–117; 144/162 R, 172, 174, 218, 220, 241, 173

[56] References Cited

U.S. PATENT DOCUMENTS

| | | | |
|---|---|---|---|
| 3,654,681 | 4/1972 | Stein | 407/115 |
| 3,981,337 | 9/1976 | Sundstrom | 144/241 |
| 4,082,127 | 4/1978 | Miller | 144/220 |
| 4,390,132 | 6/1983 | Hutson et al. | 241/92 X |
| 4,669,516 | 6/1987 | Carpenter et al. | 144/241 |
| 4,754,789 | 7/1988 | Jonsson | 144/241 |
| 4,771,718 | 9/1988 | Carpenter et al. . | |
| 4,850,408 | 7/1989 | Carpenter et al. . | |
| 4,997,018 | 3/1991 | Carpenter et al. . | |
| 5,271,440 | 12/1993 | Bradstreet, Jr. et al. . | |
| 5,271,442 | 12/1993 | Carpenter et al. . | |
| 5,348,065 | 9/1994 | Meyer | 144/241 X |
| 5,373,876 | 12/1994 | Tahkanen et al. | 144/176 |

OTHER PUBLICATIONS

Brochure entitled "Key Knife For Bent–Knife" by Key Knife, Wilsonville, Oregon.

Brochure entitled "However You Cut It, Turnknife Is #1" by Iggesund Tools North America, Inc., Oldsmar, Florida.

Brochure entitled "Pac The Knife™" by Pacific/Hoe Saw and Knife Company, Portland, Oregon.

*Primary Examiner*—W. Donald Bray

*Attorney, Agent, or Firm*—Robert L. Harrington

[57] ABSTRACT

An improved chipper knife system includes reversible chipper knives having formed integrally thereon nose structures comprising a leading component of a chip breaking system. A clamp plate surface follows the nose structure and, by virtue of the nose structure taking wear, has extended life and, therefore, extended value. A simple clamp arrangement includes knife registration relative to a clamp plate and a calibration keeper bar establishes a fixed position between the clamp plate the knife holder. Knives are thereby dismounted and remounted relative to the clamp without an intermediate calibration step.

17 Claims, 3 Drawing Sheets

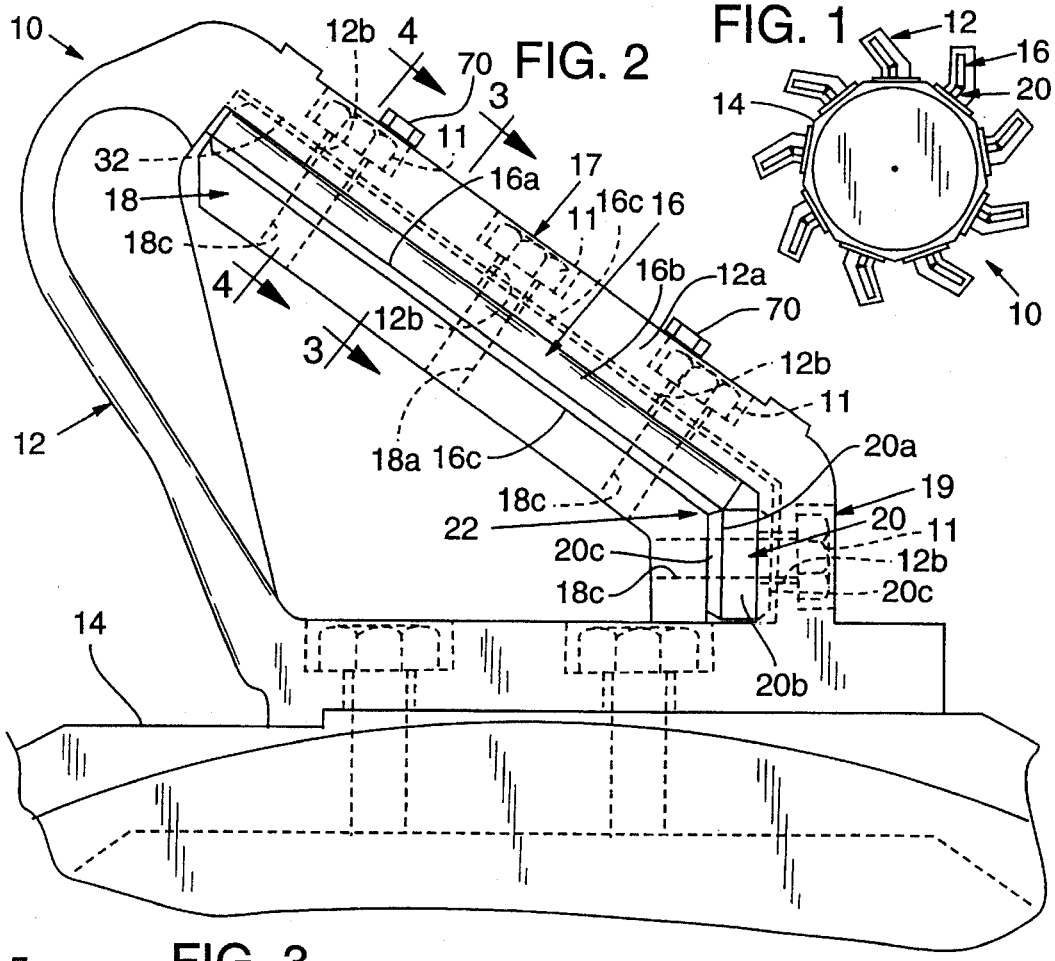
FIG. 2
10
12b
4
70
3
11
32
16a
17
18
16c
16
11
18c
4
16b
12a
12b
70
3
12b
11
12
18a
16c
20a
18c
19
22
20
11
20c
12b
18c
20c
14
20b
FIG. 1
12
16
20
14
10
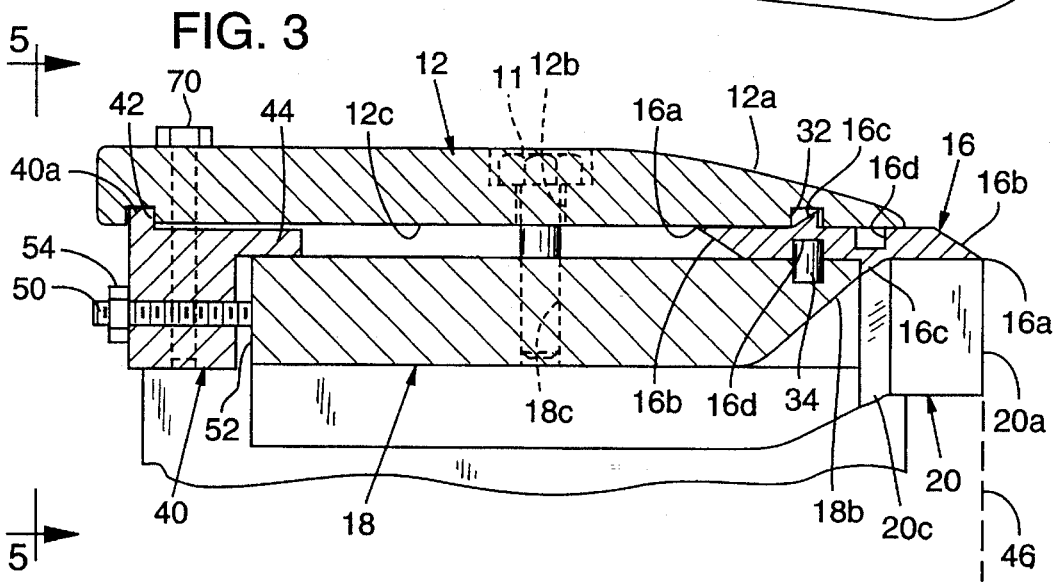
FIG. 3
5
70
42
44
12c
12
11
12b
16a
12a
32
16c
16d
16
16b
40a
54
50
16c
16a
52
18c
16b
16d
34
20a
40
18
18b
20
20c
46
5

CHIPPER KNIFE

BACKGROUND OF THE INVENTION

The present invention relates generally to wood processing apparatus, and particularly to a wood chipping knife and associated mounting assembly.

A chipper is a wood processing apparatus reducing wood products or parts thereof to small articles referred to herein as "chips." Chips may be produced by reducing completely a given wood article, e.g., an entire log, or may be produced in the context of surfacing a wood article, e.g., establishing a planar surface of a log to be further processed such as by sawing.

Chips produced are useful byproducts. For example, chips are often used in fiber based products such as paper. Important characteristics of the chips produced, and establishing a value therefor, relate to quality and ease of use in producing other products. For example, chips are desirably of uniform size when applied to paper making process to make consistent the paper manufacturing process of breaking down the chips into a wood pulp. More particularly, uniform chip thickness insures that the step of "cooking" the wood chips for reduction to wood pulp can occur under consistent operating conditions. Accordingly, an important characteristic of a chipper is an ability to produce chips of consistent dimension.

A chipper generally comprises a disc structure rotating at high speed and carrying thereon a set of chipper knives. The subject matter of the present invention relates to such chipper knives and the related mounting assembly therefor. Chips are abrasive material, especially when presented to the high speed rotating chipper knives. Chipper knives and associated support structures undergo tremendous stress and wear during operation. Accordingly, chipper knives and related support structures must endure such abrasive conditions for as long as possible while still producing acceptable output, i.e., while still producing consistently dimensioned chips.

Each chipper knife includes a cutting edge and, given that a plurality of such knives work in unison, each chipper knife edge must be carefully aligned or calibrated in its mounting structure to define a common cutting plane for a given set of knife edges. In this manner, the chipper presents to an oncoming wood article a single cutting plane and as the wood article feeds into the chipper knives consistently dimensioned chips result.

A traditional "bent-knife" chipper arrangement carries on the rotating disc structure a plurality of chipper knives each of unitary construction, but presenting two cutting edges angled relative to one another. One cutting edge provides a hogging function while the other cutting edge provides a planing function. Elaborate mounting and maintenance methods and apparatus have been developed for such unitary "bent-knife" chipping systems. A more recent trend, however, has been use of dual-knife systems wherein a pair of straight edge chipping knives mounted adjacent one another in angled relation serve as a replacement for the complex and difficult to maintain unitary "bent-knife" chipping arrangements.

Thus, chipper maintenance can require a relatively high degree of expertise when mounting, dismounting, and maintaining chipper knives. Unfortunately, such expertise can be a limited resource in many wood processing installations. Furthermore, the task of and equipment required for grinding a unitary "bent-knife" is both time consuming and expensive. Any time a unitary "bent-knife" is dismounted for resurfacing, the processing of remounting within the chipper head requires babbiting and precision adjustment to establish the desired cutting plane.

Generally, dual-knife systems have as an objective a simplified registration scheme for the knife blades, i.e., simplified relative to the unitary "bent-knife" chipping systems. Also, these dual-knife systems seek to reduce the level of expertise required in dismounting and remounting chipper knives. In many cases, the chipper knives have two cutting edges, and the knives are "reversible" whereby a single knife may be dismounted, reoriented, and remounted to present a new cutting edge. As may be appreciated, in executing such dismounting and remounting of knives, the resulting configuration must still present a unified cutting plane to the oncoming wood article to maintain consistent the chip output.

U.S. Pat. No. 5,271,440 issued Dec. 21, 1993 to Joseph R. Bradstreet, Jr., et al, and entitled CHIPPER DISC ASSEMBLY HAVING EXTENDED-LIFE REGRINDABLE DISPOSABLE KNIVES shows a chipper knife assembly for a disc type wood chipper including a reversible and disposable knife with a serrated surface. The serrated surface provides predetermined registration of the knife relative to a mounting assembly whereby disc mounting and remounting of the knife requires little or no precision calibration to establish the desired cutting plane among a plurality of such knives. The chipper knife can be thereby dismounted and reground and, when remounted, advanced along the serrated clamping surface to maintain a desired edge position, i.e., to establish the desired cutting plane.

U.S. Pat. Nos. 4,771,718; 4,850,408; 4,997,018; and 5,271,442 issued Sep. 20, 1988; Jul. 25, 1989; Mar. 5, 1991; and Dec. 21, 1993 to Charles T. Carpenter and Robert M. Bailey show various forms and progressive development of a chipper disc and knife assembly including a registrable mounting structure and a reversible knife, i.e., a knife having two cutting edges with the advantage of reversibility and extending the useful life of each knife between reconditioning, i.e., honing, thereof.

The chipper knife bears by far the majority of stress and wear against the abrasive wood product. The supporting structure, however, must also necessarily be exposed to the abrasive wood product. In particular, an inclined surface of the support structure adjacent the cutting edge of the chipper knife, referred to as the "chip breaker", carries the chip away from the chipper knife and completes the task of breaking the chip into desired thickness. Accordingly, the chip breaker is necessarily exposed to the abrasive wood product, and constitutes in all known chipper systems a wear element. Typically, the chip breaker is provided as a leading face of a clamp plate holding the knife in place. Because this chip breaker is an important aspect of consistent chip size, its wear during operation represents a source of degradation in chip quality. Accordingly, the clamp plate comprising the chip breaker must be periodically replaced to maintain chip consistency.

The subject matter of the present invention addresses the above concerns in chipper knife construction and associated supporting structure.

SUMMARY OF THE INVENTION

A preferred embodiment of the present invention in a first aspect is a chipper knife comprising a chipper knife body having first and second face surfaces with at least one cutting edge formed integrally to said body. A chip breaking formation protruding from the body operates to complete chip severing when the knife engages a wood article. In this manner, the chipper knife of the present invention provides a leading, and wearing, component of a chip breaking system replaced upon replacement of the chipper knife.

In accordance with a second aspect of the present invention, a chipper knife having first and second face surfaces, a cutting edge, and a leading portion of a chip breaking surface integral thereto and spaced from the cutting edge is used in combination with a clamp capturing the knife at the first and second face surfaces. The clamp includes a following portion of a chip breaking surface cooperative with the leading portion of the chip breaking surface integral to the chipper knife body. Because the leading portion of the chip breaking surface is replaceable along with the chipper knife, the wearing component of the chip breaking system may be periodically replaced and the remaining portions may enjoy longer useful life.

The subject matter of the present invention is particularly pointed out and distinctly claimed in the concluding portion of this specification. However, both the organization and method of operation of the invention, together with further advantages and objects thereof, may best be understood by reference to the following description taken with the accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings in which:

FIG. 1 illustrates a face view of a chipper head including a plurality of knife holders and associate chipper knives mounted thereon in accordance with a preferred embodiment of the present invention.

FIG. 2 is a front view of a knife holder of FIG. 1 further detailing a clamping arrangement and a pair of knives clamped thereby.

FIG. 3 is a sectional view of the holder, clamp, and a knife of FIG. 2 as taken along lines 3—3 of FIG. 2.

DETAILED DESCRIPTION OF THE PREFERRED EMBODIMENT

Figure 4:
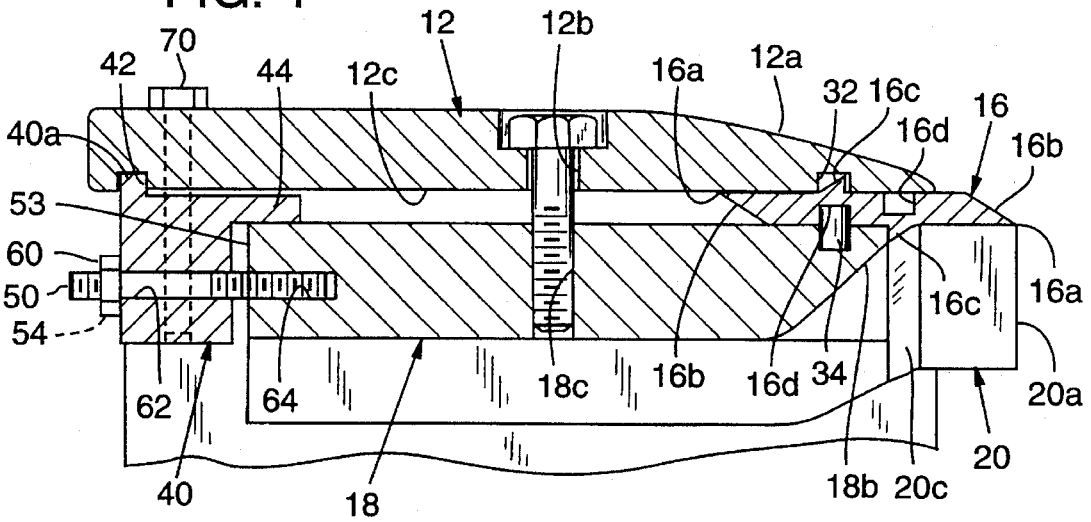
FIG. 4 is a sectional view similar to that of FIG. 3 but taken along lines 4—4 of FIG. 2.

The preferred embodiment of the invention as illustrated in the drawings comprises generally a chipper knife and associated support structure providing the desirable characteristics of reduced maintenance and reduced expertise in the task of dismounting and remounting chipper knives while maintaining consistent a cutting plane defined by a plurality of such chipper knives. Furthermore, the illustrated embodiment of the present invention improves prior chipper knife and support structure configurations by incorporating a portion of the chip breaker system into the chipper knife. In this manner, the leading portion of the chip breaker system, i.e., the wearing portion thereof, is replaced when replacing or reversing chipper knives. In this manner, the support structure for the chipper knife need not wear away and need not require periodic replacement. Overall, the chipper knife system of the present invention provides a dual edge, reversible, reusable, and eventually disposable chipper knife of small mass and small cost of manufacture.

Figure 5:
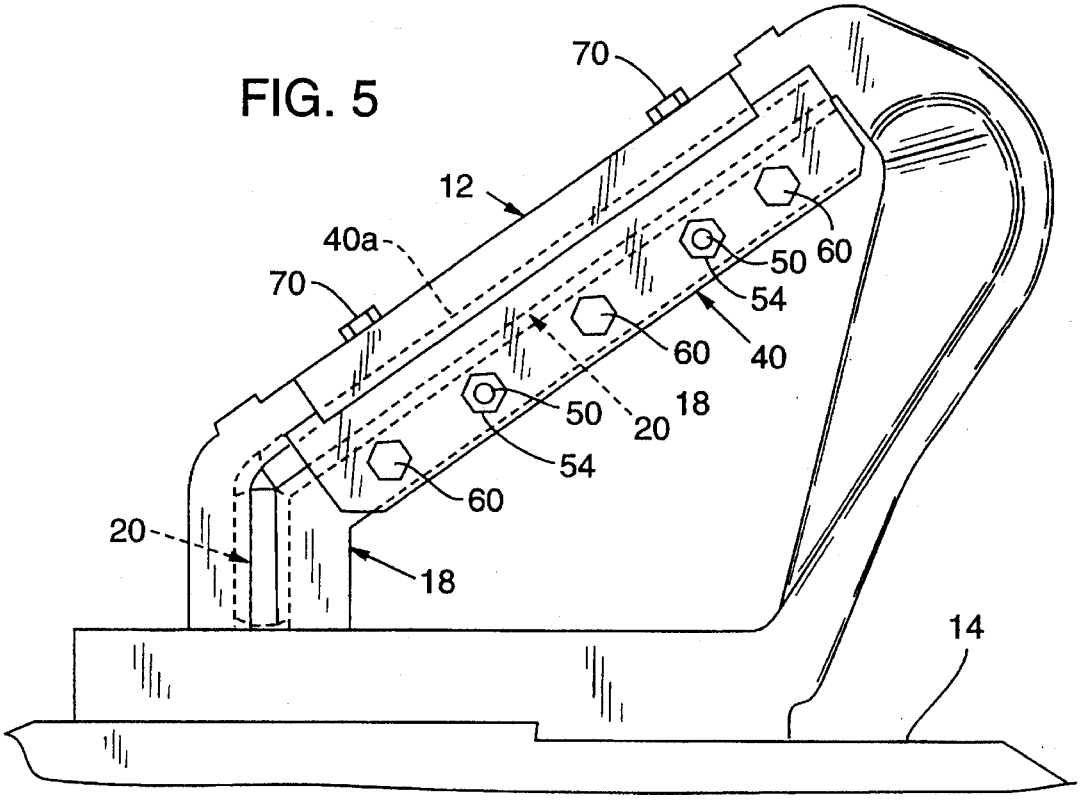
FIG. 5 is a back view of the holder, clamp, and a keeper bar as taken along lines 5—5 of FIG. 3.
Figure 6:
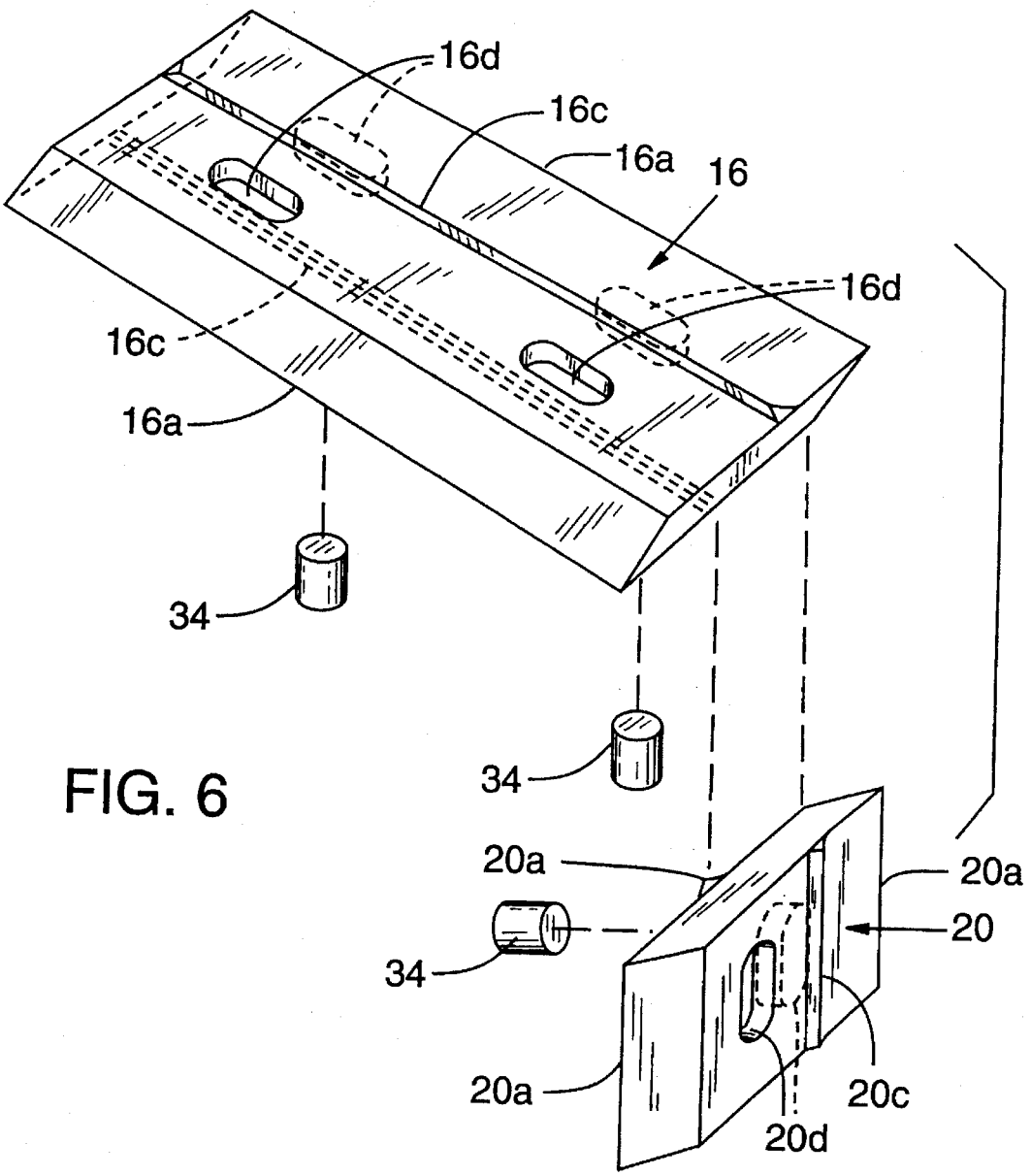
FIG. 6 is a perspective view of a pair of chipper knives held in the knife holder of FIGS. 1–5.

FIG. 1 illustrates a chipper system 10 including a plurality of knife holders 12 bolted to a chipper head 14 and carrying each a pair of knives 16 and 20. As may be appreciated, chipper head 14 rotates at high speed and a wood article is presented to the knife system 10. FIG. 2 shows knife system 10 with holder 12 bolted to the chipper head 14 in conventional manner. FIGS. 3–5 show various views of the knife system 10.

With reference to FIGS. 1–6, knife holder 12 corresponds generally to a "bent-knife" configuration, but provides by two separate straight cutting edge knives, i.e., hogging knife 16 and planing knife 20, the equivalent of a "bent-knife" arrangement. Knives 16 and 20 are each "reversible" knives, each having two cutting edges whereby extended use may be obtained from each of knives 16 and 20 by reverse mounting thereof without an intermediate surfacing step. Furthermore, and as will be explained more fully hereafter, the mounting and clamping arrangement provided for knives 16 and 20 allows pre-registration of knives 16 and 20. A relatively less skilled worker may thereby dismount knives 16 and 20, reverse orientation thereof, and remount knives 16 and 20 to present a new cutting edge without detailed, precise, and time consuming calibration of knives 16 and 20 positioning.

With particular reference to the view presented in FIG. 2, holder 12 includes an angled plate portion 17 and a vertical plate portion 19. A unitary clamp 18 corresponds in shape to that of plate portions 17 and 19 of holder 12 whereby knives 16 and 20 are captured between clamp 18 and holder 12 in a "bent-knife" configuration as illustrated. More particularly, clamp 18 captures knife 16 against the under-surface of plate portion 17 and captures knife 20 against the under-surface of plate portion 19. Holder 12 includes three counter bored apertures **12*b* through plate portion 17 and one counter bored aperture 12*b* through its plate portion 19. Clamp 18 includes four corresponding threaded apertures 18*c* whereby mounting bolts 11 passing through bores 12*b* and threadably engaging apertures 18*c* draw clamp 18 toward holder 12 and capture knives 16 and 20** therebetween.

An upper leading and inclined surface **12*a* (FIGS. 3 and 4) of holder 12 angles down toward knife 16. The cutting edges 16*a* of knife 16 terminate corresponding inclined cutting surfaces 16*b* of the knife 16. In accordance with the present invention, knife 16 includes ridge or nose structures 16*c* on each side integrally formed with knife 16 and providing, as described more fully hereafter, a leading and wearing component of a chip breaking system of the knife system 10. Clamp 18 provides a leading and inclined surface 18*b* (FIGS. 3 and 4) directed toward the knife 16. Surface 18*b*, generally co-planar with the exposed surface of one of nose structures 16*c*, completes the chip breaking surface for the knife system 10**.

Planing knife 20 includes components similarly labeled, i.e., edges **20*a*, inclined cutting surfaces 20*b*, and noses 20*c* on each side. The noses 16*c* and 20*c* are beveled as indicated generally by reference numeral 22 (FIG. 2) to accommodate the close joining of knives 16 and 20 to form a single corner point for the combined knife edges 16*a* and 16*b*** to establish a "bent-knife" configuration.

Because nose structures **16*c* and 20*c* comprise the leading and wearable components of the chip breaking system, the surface 18***b* of clamp 18 does not significantly wear, and clamp 18 need not be periodically dismounted and replaced or repaired in order to maintain consistent chip size and quality. When knives 16 and 20 are replaced or reoriented, new leading portions, i.e., noses 16*c* and 20*c*, of the chip breaking system are provided. Accordingly, the present invention provides a disposable chip breaking component for the chipper knife system 10. Nose structures 16*c* and 20*c* eliminate opportunity for sawdust and particles to wedge also between the knives 16 and 20 and supporting clamp 18. Such wedging of sawdust is significant problem and can actually result in throwing a chipping knife during operation due to the loss of clamp force.

The following discussion will focus on the relationship between knife 16, clamp 18, and holder 12. It will be understood, however, that the structure and mounting of knife 20 is similar to that of knife 16. Knife 20 may be taken as virtually identical to knife 16 except for the lateral dimension, i.e., parallel to cutting edge 20*a*. Thus, as will be appreciated by those skilled in the art, the following description of knife 16 and its relationship to clamp 18 and holder 12 also supports a complete understanding of the same relationship between knife 20, clamp 18, and holder 12.

In FIG. 3, the holder 12 is shown including one of the counter bores 12*b* in opposition to one of the threaded bore 18*c* of clamp 18. The knife 16 is shown in cross section including cutting edges 16*a* and inclined cutting surfaces 16*b*. Also shown integral to knife 16 are the nose structures 16*c* having triangular crosssection in the view of FIG. 3 and residing on opposing sides of knife 16. The downward facing nose structure 16*c*, in the view of FIG. 3, cooperates with the surface 18*b* of clamp 18 to define, as noted above, a chip breaking surface indicated at reference numeral 30. The upward facing nose 16*c* resides within a relief 32 of holder 12. More specifically, relief 32 is an elongate channel provided in the downward facing surface 12*c* of holder 12.

Knife 16 further includes upper and lower registration slots 16*d*. Slots 16*d* run parallel to knife edge 16*a*. Each downward facing slot 16*d* receives a corresponding upstanding dowels 34 integral to the clamp 18. At least two dowels 34 should be provided for knife 16 maintain appropriate registration of the knife 16 relative to clamp 18. As may be appreciated, knife 20 includes a registration slot 20*d* and receives corresponding dowels for fixed positional relationship relative to clamp 18. In the contemplated form of the present invention, a single dowel 34 can be used in the slot 20*d* of knife 20. Knife 20 may be provided with additional registration surfaces, i.e., its side edges bearing against a portion of holder 12, whereby a single dowel 34 fixes the position and orientation of edge 20*a* relative to clamp 18. Once knife 20 is secured in position, knife 16 is adjusted laterally, i.e., moved parallel to its edge 16*a*, to establish a desired relative position between knives 16 and 20. Dowels 34 should not "bottom out" in the registration slots, e.g., dowel 34 height is less than slot 16*d* depth. As may be appreciated, dowels 34 may be integrated into clamp 18 by drilling and pressing dowels 34 therein. Accordingly, dowels 34 may be of different, i.e., stronger and less wearable, material relative to that of clamp 18. The upward facing slot 16*d* is covered by the downward facing (in the view of FIG. 3) surface 12*c* of holder 12.

Thus, knives 16 and 20 have fixed position relation, i.e., are registered, relative to clamp 18 by virtue of the registration slots 16*d* and 20*d*, respectively. Positional adjustment for knives 16 and 20 is further accomplished, therefore, by adjusting the position of clamp 18. Because clamp 18 is held in place by bolts 11 threaded into apertures 18*c*, bores 12*b* of holder 12 should be slightly oversized to accommodate slight movement of clamp 18 in calibrating the position of knives 16 and 20. Bores 12*b* may be oversized, therefore, by 1/16 to 1/8 inch relative to the diameter of bolts 11.

A keeper bar 40 lies intermediate of holder 12 and clamp 18 at the rear portion, i.e., most distant from knife 16, of holder 12 and clamp 18. Keeper bar 40 includes an upstanding elongate key 40*a* received closely within a keyway 42 of holder 12. In other words, a close tolerance exists between key 40*a* and keyway 42 whereby keeper bar 40 maintains fixed position relative to holder 12. Keeper bar 40 includes a forward protruding ear 44 of height corresponding generally to the height, i.e., thickness, of blade 16. In this manner, by capturing ear 44 and blade 16 between holder 12 and clamp 18 and tightening mounting bolts 11 provided in bores 12*b* and apertures 18*c*, knife 16 is well secured between the holder 12 and clamp 18.

Keeper bar 40 provides an adjustment mechanism defining a cutting plane 46 relative to holder 12. As may be appreciated, keeper bar 40 also provides adjustment to define a cutting plane for knife 20 relative to holder 12. More particularly, with the keeper bar 40 maintained in fixed position relative to holder 12, i.e., by virtue of key 40*a* and keyway 42, clamp 18 is adjustably positioned relative to keeper bar 40, and thereby adjustably positioned relative to holder 12. Additionally, a set of locking bolts 70 couples holder 12 and keeper 40 to further fix the position of keeper 40 relative to holder 12. By positioning of all clamps 18, one positions of all knives 16 and 20. Adjusting screws 50 threadably engage keeper bar 40 and protrude therefrom to abut a rear edge 52 of clamp 18. Each of adjusting screws 50 further include a lock nut 54. In this manner, the position of clamp 18 is precisely adjusted relative to keeper bar 40, and therefore relative to holder 12.

Once the adjustment screws 50 are suitably positioned, a set of locking bolts 60 (FIG. 4) fix the position of clamp 18 relative to keeper bar 40. More particularly, each of bolts 60 pass through a bore 62 of keeper bar 40 and threadably engage a tapped bore 64 of clamp 18. In other words, the locking bolts 60 draw the clamp 18 back towards keeper bar 40 and against screws 50 to lock the relative position between keeper bar 40 and clamp 18. Clamp 18 is thereby positioned relative to the keeper bar 40 by use of adjustment screws 50 and locked in position by drawing clamp 18 against the adjustment screws 50 by operation of locking bolts 60. FIG. 5 further illustrates the adjustment screws 50, locking bolts 60, and locking bolts 70.

Thus, present invention provides in its preferred form nose structures 16*c* and 20*c* integral to the chipping knives 16 and 20 providing a leading, wearing component of the chip breaking surface. When the knife is reversed, i.e., other cutting edge selected, the system also has in addition to a new cutting edge a new leading portion of the chip breaking surface. The noses 16*c* and 20*c* do wear, but are easily replaced and maintained consistently over time to provide consistent chip size and thickness important in subsequent processing of chips.

As may be appreciated, a relatively less skilled worker can release clamp 18, grab the knives 16 and 20, flip over knives 16 and 20, and tighten clamp 18 without recalibrating knives 16 and 20 relative to cutting plane 46. Prior chipper knife configurations, especially unitary "bent-knife" configurations, require elaborate adjustment or calibration in establishing the cutting plane relative to the holder whenever a knife is dismounted. Under the present invention, however, a relatively small amount of downtime and expertise are required for the maintenance of the knife system 10.

Knives 16 and 20 are of significantly less mass than traditional unitary "bent-knife" configurations. Knives 16 and 20 are not only reversible, i.e., having cutting edges on both sides, but also are flipped-over when presenting a new cutting edge. By such configuration, the transverse edge-to-edge dimension of each of knives 16 and 20 is minimized. More particularly, with respect to knife 16, and also applicable to knife 20, the slots 16*d* and noses 16*c* share space along the dimension transverse to edges 16*a*. Prior reversible chipper knives maintain the same knife side in an upward facing direction, i.e., are not flipped-over when reversing edges. Under the configuration of the present invention, however, even with the incorporation of noses 16*c* and slots 16*d*, the overall dimension between cutting edges is minimized. By reducing the dimension of knives 16 and 20, overall mass is reduced with corresponding less cost of manufacture. Also, less horse power is required to rotate a set of such knives 16 and 20.

Furthermore, the configuration of knives 16 and 20 supports improved registration with respect to clamp 18. In particular, each of the cutting edges 16*a* has its own corresponding registration slot 16*d* and each of the cutting edges 20*a* has its own corresponding registration slot 20*d*. By providing independent registration structures for each cutting edge, a consistent dimension is maintained between the cutting edge and associated registration slot. Honing procedures applied to one cutting edge do not affect registration of the other cutting edge. Thus, the registration structure for each of the cutting edges is independent relative to that of the other cutting edge on the same knife. Overall, by providing independent registration structures relative to the wearing and periodically honed cutting edges provides more consistent overall chip size.

The knives 16 and 20 may also be considered "disposable" knives, after having been honed several times. This satisfies an industry need for reusable, disposable chipper knives and also satisfies a need for little or no expertise or precise calibration steps when reversing chipper knives. Once the knife system 10 of the present invention is calibrated relative to the cutting plane 46, i.e., the clamp 18 is adjusted to establish desired position for all knives 16 and 20 on cutter head 14, no further calibration steps are required. Thus, following initial setup of knife system 10, substantially less downtime is taken to reverse chipper knives 16 and 20.

By incorporating the nose structures 16*c* into the chip breaking surface of the knife system, the relatively more permanent clamp 18 need not be a wear structure in the knife system, but rather is protected by virtue of the nose structures 16*c* and 20*c*. Accordingly, by use of the knife system 10 of the present invention the supporting holder and clamp system have extended life, thereby contributing to increased value in the investment in such equipment.

It will be appreciated that the present invention is not restricted to the particular embodiment that has been described and illustrated, and that variations may be made therein without departing from the scope of the invention as found in the appended claims and equivalents thereof.

What is claimed is:

1. A chipper knife comprising:

a generally planar body defining first and second opposing face surfaces, each face surface including a clamping portion for mounting of said knife and an exposed portion;

a cutting surface terminating in a cutting edge; and a nose formation integral to said planar body at said first face surface and defining a border between said clamping portion and said exposed portion of said first face surface, said nose formation including an inclined chip breaking surface directed toward said first face surface in a direction from said clamping portion to said exposed portion of said first face surface.

2. A chipper knife according to claim 1 wherein said knife further comprises:

a second cutting surface terminating in a second cutting edge opposite said first cutting edge; and a second nose formation integral to said planar body at said second face surface and including a second inclined chip breaking surface directed toward said second face surface in a direction from said clamping portion to said exposed portion of said second face surface.

3. A chipper knife according to claim 2 wherein said first mentioned cutting surface and said second cutting surface are substantially parallel.

4. A chipper knife according to claim 2 wherein said knife further comprises:

a first registration structure having fixed position relative to said first mentioned cutting edge; and a second registration structure having fixed position relative to said second cutting edge, each of said first and second registration structures a providing predetermined mounting position for said knife relative to and when mounted to an associated clamping structure in corresponding first and second orientations.

5. A chipper knife according to claim 1 wherein said nose formation comprises a ridge protruding from said first face surface.

6. A chipper knife according to claim 5 wherein said ridge is of generally triangular cross-section, said inclined chip breaking surface coincident with a first surface of said triangular cross-section, a second surface of said triangular cross-section being substantially perpendicular to said first face surface, a third surface of said triangular cross-section being integral to said body.

7. In combination:

a chipper knife having first and second face surfaces, a cutting edge, and a leading portion of a chip breaking surface integral thereto and spaced from said cutting edge; and a clamp capturing said knife at said first and second face surfaces, said clamp including a following portion of a chip breaking surface cooperative with said leading portion of said chip breaking surface to complete chip severing from a wood article when said knife is captured by said clamp.

8. A combination according to claim 7 wherein said leading portion of said chip breaking surface is a surface of a ridge formation integral to said chipper knife and positioned to contact a chip severed from a wood product by said knife before contact by said following portion of said chip breaking surface.

9. A combination according to claim 7 wherein said leading and following chip breaking surfaces are generally co-planar and adjacent when said knife is captured by said clamp.

10. A combination according to claim 7 wherein said knife further comprises a second cutting edge and a second leading portion of a chip breaking surface whereby said knife may be repositioned relative to said clamp to sever chips at said second cutting edge and said second leading portion of said chip breaking surface is cooperative with said clamp to complete chip severing from a wood article.

11. A chipper knife comprising:

a chipper knife body having first and second face surfaces;

a cutting edge formed integral to said body; and a chip breaking formation protruding from said body and operative to complete chip severing when said knife engages a wood article.

12. A chipper knife according to claim 11 wherein said chip breaking formation is an elongate ridge and said cutting edge is substantially parallel to said chip breaking formation.

13. A chipper knife according to claim 11 wherein said chip breaking formation is triangular in cross-section and protruding from said first face surface with a facet thereof closest to said cutting edge and angled into said first surface in a direction toward said cutting edge.

14. A chipper knife according to claim 11 wherein said chip breaking formation protrudes from said first face surface and said knife further comprises:

a second cutting edge opposite said first cutting edge; and a second chip breaking surface protruding from said second face surface.

15. A chipper knife according to claim 14 wherein said knife further comprises:

a first registration structure for mounting relative to a clamp and having fixed position relative to said first cutting edge; and a second registration structure for mounting relative to a clamp and having fixed position relative to said second cutting edge.

16. A chipper including a chipper knife and mounting mechanism for releasably mounting the chipper knife to a chipper body, said chipper knife comprising a planar body defining opposed parallel face surfaces and opposed parallel edge surfaces, said edge surfaces angled relative to said face surfaces whereby one edge surface forms an acute angle with one face surface and the other edge surface forms an acute angle with the other face surface, said acute angles forming sharp cutting edges at opposite faces of the knife whereby the knife can be inverted to exchange the positions of the cutting edges and provide the same profile configuration, and a registration feature provided on each face surface; and said mounting mechanism including a registration feature provided on said chipper body and cooperative with the registration features of both face surfaces to selectively position the corresponding cutting edge at a desired cutting edge location.

17. A chipper as defined in claim 16 wherein the registration feature of each face surface includes a slot having a defined width and extended parallel to the corresponding cutting edge, each slot positioned at the same distance from the corresponding cutting edge of that face surface, and said registration feature provided on said chipper body includes a dowel precisely dimensioned to fit the width of said slots whereby positioning the knife with either slot fitted to the dowel positions the cutting edge of the corresponding face surface at the desired cutting edge location.

* * * * *